US007597750B1

(12) United States Patent
Krigmont

(10) Patent No.: US 7,597,750 B1
(45) Date of Patent: Oct. 6, 2009

(54) HYBRID WET ELECTROSTATIC COLLECTOR

(76) Inventor: Henry Krigmont, 3600 Marigold St., Seal Beach, CA (US) 90740

( * ) Notice: Subject to any disclaimer, the term of this patent is extended or adjusted under 35 U.S.C. 154(b) by 0 days.

(21) Appl. No.: 12/152,087

(22) Filed: May 12, 2008

(51) Int. Cl.
*B03C 3/014* (2006.01)

(52) U.S. Cl. ..... 96/49; 55/DIG. 38; 96/52; 96/66; 96/69; 96/98

(58) Field of Classification Search ..... 96/45, 96/49, 52, 66, 69, 95–100; 55/DIG. 38
See application file for complete search history.

(56) References Cited

U.S. PATENT DOCUMENTS

| | | | | | |
|---|---|---|---|---|---|
| 1,345,790 | A | | 7/1920 | Lodge | 96/62 |
| 1,356,462 | A | | 10/1920 | Nesbit | 96/87 |
| 1,605,648 | A | * | 11/1926 | Cooke | 95/79 |
| 2,654,438 | A | | 10/1953 | Wintermute | 96/62 |
| 3,248,857 | A | * | 5/1966 | Weindel et al. | 96/49 |
| 3,315,444 | A | | 4/1967 | De Seversky | |
| 3,440,800 | A | * | 4/1969 | Messen-Jaschin | 96/52 |
| 3,785,125 | A | * | 1/1974 | DeSeversky | 96/45 |
| 3,803,808 | A | * | 4/1974 | Shibuya et al. | 96/54 |
| 3,818,678 | A | * | 6/1974 | Gothard | 95/75 |
| 3,839,185 | A | * | 10/1974 | Vicard | 204/665 |
| 3,915,676 | A | | 10/1975 | Reed et al. | 55/432 X |
| 4,124,359 | A | | 11/1978 | Geller | 55/130 |
| 4,147,522 | A | | 4/1979 | Gonas et al. | 55/467 X |
| 4,203,948 | A | * | 5/1980 | Brundbjerg | 422/121 |
| 4,354,858 | A | | 10/1982 | Kumar et al. | |
| 4,357,151 | A | | 11/1982 | Helfritch et al. | 55/302 X |

(Continued)

FOREIGN PATENT DOCUMENTS

GB 2016305 A * 9/1979 ..... 96/96

(Continued)

OTHER PUBLICATIONS

U.S. Appl. No. 12/002,505, filed Dec. 17, 2007.

(Continued)

*Primary Examiner*—Richard L Chiesa
(74) *Attorney, Agent, or Firm*—Clifford Kraft

(57) ABSTRACT

A hybrid wet electrostatic precipitator for collecting sub-micron and nano-particulate material. The collector can be made up of three concentric tubes or pipes with an internally formed gas path communicating between an inlet and an outlet. A first collector and discharging zone can be provided in the gas path to create a corona discharge to charge particles and to collect particulate. A second collector can be formed by a porous wall which can act as a filtration device. A third collector can be formed by two or more of the concentric circular tubes, one porous and one solid, with a zone of uniform electric field between them. The porous tube can be either the inner tube or the middle tube. A liquid pool can be placed between the first and third collectors to provide chemical treatment of the gas flow or simply filtration as the gas passes through. A high-tension voltage supply can be used to supply a discharge voltage capable of generating a corona discharge into the flow in the first zone. The corona discharge can cause the fine particulate to become charged and to be captured on the collecting electrode in a zone of uniform field. A second (or the same) high-tension voltage supply can create the uniform electric field.

20 Claims, 3 Drawing Sheets

U.S. PATENT DOCUMENTS

| | | | | |
|---|---|---|---|---|
| 4,375,364 | A | 3/1983 | Van Hoesen et al. | 96/87 |
| 4,411,674 | A | 10/1983 | Forgac | 55/304 |
| 4,505,795 | A | 3/1985 | Alamaro | 204/179 |
| 4,657,738 | A | 4/1987 | Kanter et al. | 422/186.04 |
| 4,695,358 | A | 9/1987 | Mizuno et al. | 204/174 |
| 4,874,586 | A | 10/1989 | Szymanski et al. | 55/380 X |
| 4,904,283 | A | 2/1990 | Hovis et al. | 96/66 |
| 4,911,901 | A | 3/1990 | Ogawa et al. | |
| 5,024,681 | A | 6/1991 | Chang | 95/70 |
| 5,024,685 | A * | 6/1991 | Torok et al. | 96/43 |
| 5,066,313 | A | 11/1991 | Mallory, Sr. | 95/57 |
| 5,154,733 | A * | 10/1992 | Fujii et al. | 95/57 |
| 5,158,580 | A | 10/1992 | Chang | 95/70 |
| 5,173,098 | A | 12/1992 | Pipkorn | 55/379 |
| 5,185,015 | A * | 2/1993 | Searle | 96/16 |
| 5,217,511 | A | 6/1993 | Plaks et al. | 55/334 X |
| 5,300,270 | A | 4/1994 | Krigmont | 423/239 |
| 5,433,772 | A | 7/1995 | Sikora | 96/87 |
| 5,527,569 | A | 6/1996 | Hobson et al. | 55/382 X |
| 5,531,798 | A | 7/1996 | Engström et al. | 48/77 |
| 5,547,493 | A | 8/1996 | Krigmont | 96/54 |
| 5,547,496 | A | 8/1996 | Hara | 96/79 |
| 5,582,632 | A * | 12/1996 | Nohr et al. | 95/78 |
| 5,601,791 | A | 2/1997 | Plaks et al. | 422/169 |
| 5,695,549 | A * | 12/1997 | Feldman et al. | 96/55 |
| 5,733,360 | A * | 3/1998 | Feldman et al. | 95/78 |
| 5,938,818 | A | 8/1999 | Miller | 95/63 |
| 5,944,857 | A | 8/1999 | Edwards et al. | 29/25.01 |
| 5,993,738 | A | 11/1999 | Goswani | 422/22 |
| 6,149,717 | A | 11/2000 | Satyapal et al. | 96/16 |
| 6,152,988 | A | 11/2000 | Plaks et al. | 95/58 |
| 6,193,782 | B1 * | 2/2001 | Ray | 95/4 |
| 6,221,136 | B1 * | 4/2001 | Liu et al. | 96/66 |
| 6,231,643 | B1 | 5/2001 | Pasic et al. | |
| 6,245,299 | B1 * | 6/2001 | Shiloh et al. | 422/121 |
| 6,247,301 | B1 | 6/2001 | Brännström et al. | 60/39.12 |
| 6,294,003 | B1 * | 9/2001 | Ray | 96/49 |
| 6,340,379 | B1 | 1/2002 | Penth et al. | 95/45 |
| 6,429,165 | B1 | 8/2002 | Nastke et al. | 55/524 X |
| 6,482,371 | B1 | 11/2002 | Rasmussen | 423/1 |
| 6,482,373 | B1 | 11/2002 | Hannaford et al. | 423/47 |
| 6,514,315 | B1 | 2/2003 | Chang | 95/70 |
| 6,517,786 | B1 | 2/2003 | Best et al. | 422/186.04 |
| 6,524,369 | B1 | 2/2003 | Krigmont | 95/78 |
| 6,527,834 | B1 | 3/2003 | Jörder et al. | 55/524 X |
| 6,544,317 | B2 * | 4/2003 | Miller | 95/63 |
| 6,585,809 | B1 * | 7/2003 | Parsa | 96/16 |
| 6,623,544 | B1 | 9/2003 | Kaura | 95/3 |
| 6,660,061 | B2 * | 12/2003 | Josephson et al. | 95/2 |
| 6,783,575 | B2 | 8/2004 | Pasic et al. | |
| 6,869,467 | B2 * | 3/2005 | Scheuch | 96/55 |
| 6,926,758 | B2 * | 8/2005 | Truce | 95/78 |
| 6,932,857 | B1 | 8/2005 | Krigmont | 95/63 |
| 7,105,041 | B2 * | 9/2006 | Dunn | 96/66 |
| 7,112,236 | B2 * | 9/2006 | Hoverson et al. | 95/78 |
| 7,264,658 | B1 * | 9/2007 | Heckel et al. | 96/62 |
| 7,267,712 | B2 | 9/2007 | Chang et al. | 96/77 |
| 7,270,692 | B2 | 9/2007 | Gillingham et al. | 55/486 |
| 7,300,499 | B1 | 11/2007 | Fleisher | 96/16 |
| 7,332,020 | B2 * | 2/2008 | Tanaka et al. | 96/66 |
| 2003/0177901 | A1 * | 9/2003 | Krigmont | 95/78 |
| 2004/0025690 | A1 * | 2/2004 | Krigmont | 95/78 |
| 2006/0254423 | A1 * | 11/2006 | Tanaka et al. | 96/66 |
| 2006/0278082 | A1 * | 12/2006 | Tomimatsu et al. | 96/66 |
| 2007/0068387 | A1 * | 3/2007 | Pletcher et al. | 96/83 |
| 2007/0157814 | A1 * | 7/2007 | Kim et al. | 96/61 |
| 2007/0283810 | A1 * | 12/2007 | Besi | 96/64 |
| 2008/0092736 | A1 | 4/2008 | Krigmont et al. | 95/78 |

FOREIGN PATENT DOCUMENTS

| | | | | |
|---|---|---|---|---|
| JP | 5-96125 A * | 4/1993 | | 96/16 |

OTHER PUBLICATIONS

U.S. Appl. No. 11/977,119, filed Oct. 23, 2007.
U.S. Appl. No. 12/009,374, filed Jan. 19, 2008.
ing. Morgens Rubner-Peterson et al. "Desulphurization Technology: Jet Bubbling Reactor CT-121", Oct. 20, 2005.

* cited by examiner

HYBRID WET ELECTROSTATIC COLLECTOR

BACKGROUND

1. Field of the Invention

The present invention relates generally to the field of hybrid collectors and more particularly to a hybrid wet electrostatic collector for collecting sub-micron and nano-particulate material.

2. Description of the Prior Art

There are cases in industrial applications where, before emitting industrial waste gases into the atmosphere such as exhaust gases of boilers in factories or smoke from power generating plants, air purification processing is performed to remove various types of fine particulates contained in these waste gases. These fine particulates include mist and/or dust with powders containing oil, moisture, and/or the like, which can pollute the atmosphere. Direct emission of the industrial waste gases containing the fine particulate into the atmosphere significantly affects the global environment, and hence, it is many times obligatory to perform collection by national or local standards. In addition, in municipal zones, air pollution resulting from automobile exhaust gases is a serious issue causing even ordinary homes to sometimes have and use an air cleaning apparatus. In many sites, such as kitchens of restaurants, there are exhaust cleaning apparatuses for cleaning exhaust gas before it is emitted to the ambient. This can include polluted air and smoke generated during cooking and the like.

A dust collector can be used to collect fine particles contained in an exhaust which can cause air pollution. Dust collectors used to collect fine particles contained in polluted exhaust can be classified into several types based on the collection principle used. They can be classified as filtration, gravitational, inertial, centrifugal, dust precipitation, and wet types, as well as other types. They are normally selected for practical use depending on, for example, the size and type of fine particulate to be collected, and/or the installation conditions of the apparatuses. In particular, of the types described above, the filtration type (using a bag filter or the like), and the dust precipitation type are excellent from the viewpoint of the dust collection capability. These are widely used in various industrial fields. There is also a separate class of the apparatuses incorporating a combination of the above types termed "hybrid" devices. Purely electrostatic precipitators, known in the art, fall into the category of dust precipitation types.

The dust collection principle used by electrostatic precipitators is such that electric charges can be supplied to the fine particulate through corona discharges generated from discharge electrodes, and coulomb forces in other zones of the collector can then be used to electrostatically attract the charged fine particulate onto collector electrodes which are opposed electrodes, whereby the fine particulate is collected. The electrostatic precipitator has significant advantages over other collector types. For example, 1) low pressure loss; 2) a large amount of gas can be processed; and 3) high collection efficiency. For these reasons and others, electrostatic dust precipitators find wide use in such environments as factories, industrial and power generating plants, which emit large amounts of polluted exhaust gases.

Generally, the construction of prior art electrostatic precipitators includes (i) discharge electrodes each formed into a shape having a sharp (small) surface curvature, such as a needle or wire material, for generating corona discharges and supplying electric charges to the fine particulate; (ii) collector electrodes, as opposed electrodes, each formed into a tube, pipe, circular or a flat plate for collecting the charged fine particulate; (iii) a dust removal device (dry type) or a spray device (wet type) for separating collected fine particulate from the collector electrodes; (iv) a hopper or a trough for collecting the separated fine particulate; and (v) a power source for supplying the power to the electrostatic precipitator to cause the required electric collection fields and corona discharges. A dust removal device is normally used with a dry electrostatic precipitator where collector electrodes are rapped by a hammer-like device to dislodge collected fine particulate. The discharged particulate is then stored into a collection unit such as a hopper or a trough provided in a lower portion of the device.

In the wet type device, fine particulate collected onto the collector electrodes is washed and removed by an injected cleaning solution such as water. When a large amount of the fine particulate has collected onto the collector electrodes and not removed, the Coulomb force for attracting the charged fine particulate may be reduced thereby reducing the collection efficiency. In addition, if the weight of the dust accumulated on the collector electrodes exceeds the electrical (Coulomb) forces holding dust on the collector electrodes, a random dust dislodging may take place resulting in the dust re-entrainment, increased emissions, etc. Therefore, in order to prevent the case where the dust collection cannot be performed in a stable state, the dry and wet types of removal are normally used to remove the fine particulate from the collector electrodes.

In recent years, various apparatus types in which discharge, collector electrodes and filters or mechanical collectors are housed in a common housing have been used. In this type of "hybrid" collector, the electrostatic precipitator and mechanical filter both work synergistically to assist each other in a common goal to reach ultra-fine particulate collection efficiency. Consequently, the overall emissions of fine particulate are significantly reduced from those of non-hybrid types of collectors.

The collectors that have been described generally remove particular matter from the exhaust gas flow. In addition, there are processes intended to also remove polluting gases from the flow. One example is the wet desulfurization process in which a flue gas is contacted with a solution or slurry containing an absorbent for removing air pollutants such as $SO_2$ and fly ash. Various such processes have been proposed, and a number of large commercial apparatuses are currently deployed for the treatment of flue gas from thermal power boilers, industrial and other commercial operations. Processes in which limestone is used as the absorbent and in which gypsum is produced as a by-product are most commonly used.

Specifically, the process known as CT-121 in which a flue gas is efficiently purified by totally treating not only $SO_2$ but also other air pollutants which include fly ash, HCl and HF and which are contained in a large amount in coal-fired boiler flue gas includes the following steps (See U.S. Pat. No. 4,911,901):

i. introducing the flue gas into the scrubber vessel through a vertical, open-ended pipe to form an annular jet stream or a gas-continuous flow accompanied with liquids and solids, so that portions of the $SO_2$ and the fly ash contained in the flue gas are transferred to the liquid;

ii. sparging the annular jet stream from the vertical, open-ended pipe into a pool of aqueous absorbent held in a well-mixed vessel to form a jet bubbling layer or a liquid/solid/gas three phase mixed layer, which contains fine bubbles in the liquid-continuous phase of a shallow upper zone of the aqueous absorbent, so that a greater part of the $SO_2$ and the fly ash are removed from the gas;

iii. dispersing air into the pool in the reactor below the jet bubbling layer to provide streams of fine oxygen-containing gas bubbles throughout the whole vessel including the jet bubbling layer, so that the absorbed $SO_2$ and other sulfites are oxidized to form coarse gypsum crystals while chemical oxygen demand of the absorbent is reduced; and iv. withdrawing a portion of the aqueous absorbent to maintain the concentration of the gypsum in a predetermined range.

The exhaust gas leaving the jet bubbling layer enters the final cleaning stage and after removal of entrainments in a mist eliminator; the purified gas is then discharged to the atmosphere. However, the above system may also require additional steps of the post mist-elimination and fine particulate collection.

Should the mechanical, scrubbing and electrostatic collectors be connected in series to achieve the desired total results, an elaborate ductwork becomes necessary to allow exhaust gas to flow through the mechanical filter, the scrubber and then through the electrostatic precipitator or vice versa. Such arrangements are very costly and cumbersome, and they are inherently less efficient especially in a sub-micron and nano-particulate size range.

It would be advantageous to have a hybrid collector in a compact shape that could provide an integrated system for minimizing pollution which synergistically combines a mechanical filter such as a barrier filter with a two-stage electrostatic precipitator, and wherein the mechanical cleansing action of the barrier filter is rendered compatible with that of the precipitator charging and removing fine particles and with that of a flowing gaseous stream through a pool of liquid to scrub it of the gaseous pollutants. It would also be advantageous to have a hybrid collector where the precipitator is aerodynamically reconciled, and the resultant system attains optimum efficiency and functions synergistically as a single unit to remove a full spectrum of contaminants from the gas stream.

SUMMARY OF THE INVENTION

The present invention relates to a hybrid wet electrostatic precipitator for collecting sub-micron and nano-particulate material. The collector can be made up of three concentric tubes or pipes with an internally formed gas path communicating between an inlet and an outlet. A first collector and discharging zone can be provided in the gas path to create a corona discharge to charge particles and to collect particulate. A second collector can be formed by a porous wall which can act as a filtration device. A third collector can be formed by two or more of the concentric circular tubes, one porous and one solid, with a zone of uniform electric field between them. The porous tube can be either the inner tube or the middle tube. A liquid pool can be placed between the first and third collectors to provide chemical treatment of the gas flow or simply filtration as the gas passes through. A high-tension voltage supply can be used to supply a discharge voltage capable of generating a corona discharge into the flow in the first zone. The corona discharge can cause the fine particulate to become charged and to be captured on the collecting electrode in a zone of uniform field. A second (or the same) high-tension voltage supply can create the uniform electric field.

DESCRIPTION OF THE FIGURES

Attention is now drawn to several illustrations that show several of the possible embodiments of the present invention.

Several drawings and illustrations have been presented to aid in understanding the present invention. The scope of the present invention is not limited to what is shown in the figures.

DETAILED DESCRIPTION OF THE INVENTION

Figure 1:
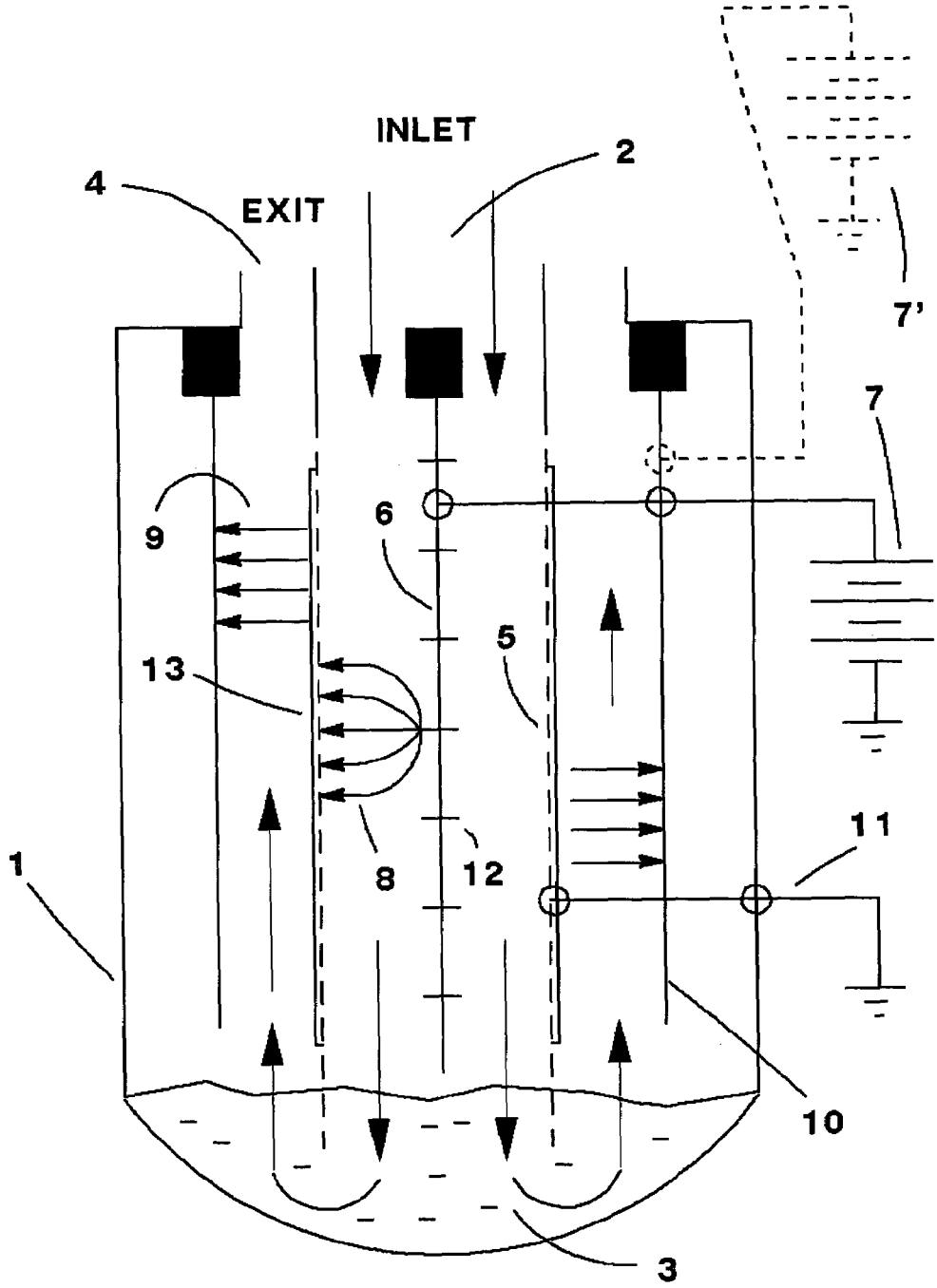
FIG. 1 shows an embodiment of the present invention where all of the gas flow passes through a pool of liquid.

The present invention relates to a hybrid wet collector for capturing sub-micron and nano-particulate material from an exhaust gas flow. Turning to FIG. 1, an embodiment of the present invention can be seen. An outer metal pipe 1 forms a housing that can contain a concentric inner pipe-shaped porous surface 5. A center rod 6 can have corona discharge electrodes or fingers 12 along its length to create a corona discharge between these electrodes 12 and the porous surface 5. A pool of liquid 3 can fill the bottom of the device up to and above the bottom of the porous tube 5. This forces any of the flow that does not pass through the porous surface 5 to pass through the liquid 3. Between the concentric outer metal housing 1 and the porous surface 5 a second electrode 10 can be located to create a uniform electric field between itself and the porous surface and between itself and the outer housing 1. At least one high-tension electrical potential 7 can be applied between the center conductor 6 and the porous surface 5 to create the corona discharge and a second, or the same high-tension electrical potential 7 or 7' can be applied the porous surface 5 and a second electrode 10 and/or between the second electrode 10 and the outer housing 1 to produce the uniform electric field. The one or two (or more) supplies of high-tension potential 7 or 7' may be DC or AC. They may produce either the same or different potential (voltage) and may be housed together or separately or be a single supply. Any combination or arrangement for producing one or more high-tension potentials is within the scope of the present invention.

An inlet 2 channels an incoming gas flow into the center of the concentric pipe-shaped collectors and into a first collecting zone inside the pipe formed from the porous material 5. Here, the flow experiences a corona discharge. Collection in this first zone occurs when charged particles adhere to the porous surface 5. The pool of liquid 3 forms a second collecting zone. Collection in this zone occurs when particles and gas components are removed by the liquid 3. The space between the concentric pipes forms a third collecting zone. Collection in this zone occurs when the uniform electric field causes charged particles to adhere to either the porous surface 5 or the outside co-centric electrode 10. While it is unlikely that many particles are able to get between the electrode 10 and the shell 1 because of the lack of flow in that zone. However, in the "unlikely" event they do, a liquid film to wash the walls can be provided. An outlet 4 located at the top of the device allows the final cleaned gas to exit the third collecting zone. While concentric pipe-shaped structures have been shown and are preferred, any structure or system of cavities are within the scope of the present invention.

The liquid pool 3 can be simply water to trap particulates, or it can contain a chemical mixture as described to collect or convert pollutant gases as well as trapping particulates. The preferred method is to use the liquid to scrub the gas flow of harmful gasses, thereby achieving the result of removing both gas pollutants and undesirable particulate matter.

The fine particulate matter contained in polluted gas can generally be any one of those typically found in industrial waste gases exhausted from, for example, factories, industrial or power plants, solid powders contained in exhaust gases from motor vehicles, or mist-state particulates containing oil and moisture exhausted from, for example, kitchens of restaurants. The fine particulate generally corresponds to particulate substances floating in exhaust gases.

The first collecting zone, as described, generally operates by passing the gas flow through a series of corona discharges. The inner conductor rod 6 is connected to a high voltage source 7 that may be either DC or AC as is known in the art. The boundary of this first zone can be the porous tube 5. This tube 5, as well as the outer metal housing wall 1, is normally grounded and connected to the return of the high voltage source 7. Discharge electrodes 12 can appear as fingers or other structures along the length of this rod and can be configured to provide a corona discharge to the porous surface 5, which forms a second electrode.

The third or final collecting zone in the embodiment of FIG. 1 is that zone between the porous surface 5 and the outer metal housing 1. The outer boundary of this third zone could be a different surface besides the outer shell. If another concentric surface is used, it could optionally be connected to a different potential if desired. A concentric or other type of electrode 10 can be present in this third zone and can also be connected to the high voltage source 7 or can optionally be connected to a second high voltage source either DC or AC as is known in the art. This electrode 10 is generally smooth and creates a substantially uniform electric field between itself and the porous surface 5 on the inside and between itself and the outer metal shell 1 or electrode surface on the outside.

The final collecting zone operates such that when a charge (for example, positive charge) is supplied to the fine particulate in the gas stream by the corona discharge, the final collector uses the Coulomb force for the porous wall side 5 having the electrically opposite polarity (corresponding to the negative polarity, in the embodiment of FIG. 1) to electrically attract and collect the fine particulate. The small amounts of the fine sub-micron and nano-particulates penetrating through the porous wall 5 enter the extremely high-tension uniform electric field of the third collecting zone for the final clean up. This zone operates such that the fine particulate charged by the corona discharge is attracted by the action of the Coulomb force to the porous collecting circular wall 5 and the outer (outside) circular pipe electrode 10 charged to the same polarity, whereby the fine particulate can be forcibly drawn through the porous wall 5 circular pipe toward the collecting surfaces of the third zone which are oppositely charged if particles are charged, say positive, they will be attracted to the porous grounded electrode (negative), and then some of them could be forced by the exhaust gas flow through to the third zone. However, because their polarity is the same as the electrode 10, they will be attracted back to the porous electrode 5. Although, a power supply 7' which is different from the 7 can be used which charges the discharge electrode 6, the particles might be attracted to the electrode 10 as well. The porous wall 5 serves as a collecting electrode for the first zone and a filtration element filtering the gases while they penetrate from the first to the third zone.

Optionally as described, the circular collecting electrodes can be provided with a thin film of liquid 13 on their collecting surfaces to wash the collected dust downwards to be retained in the bottom pool of liquid with the collected dust sludge. When such a liquid film 13 is present, the fine particulate collected can be removed in a natural manner from the collecting surfaces by a simple washing effect.

It is an optional feature of the present invention that an engineered porous material containing fused alumina, sintered stainless steel elements, porous ceramic or glass fiber and having heat/flame resistance and electric insularity to the housing can be used for at least any one of the circular collecting electrodes.

Examples of such an engineered porous material can include, for example, porous ceramic, fused alumina and sintered metals marketed by the MOTT Corporation. Any type of engineered porous material is within the scope of the present invention.

Figure 2:
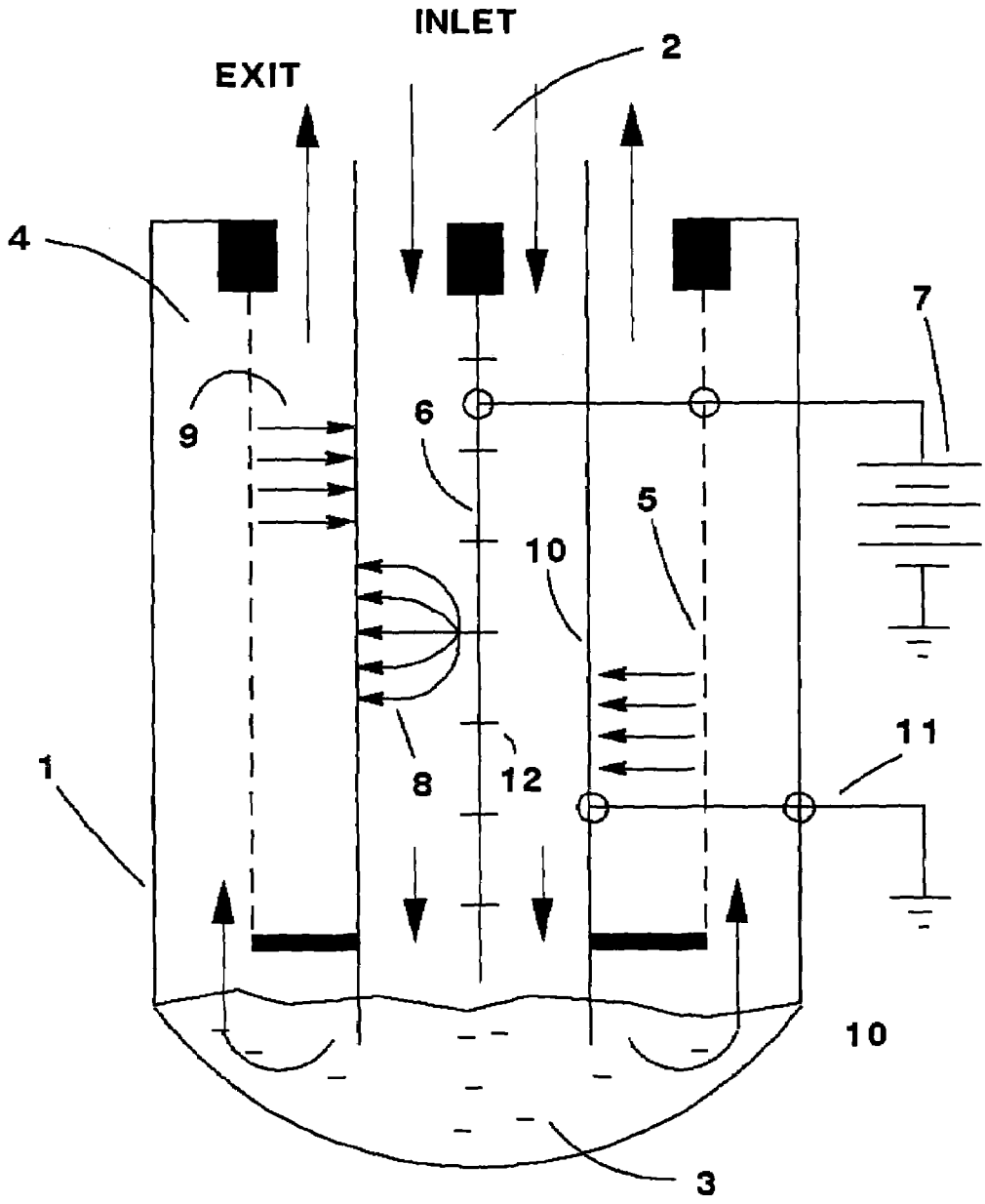
FIG. 2 shows an alternate embodiment with a different structure.

Also, both the electrostatic and mechanical collecting means can optionally be further synergistically integrated with a jet bubbling device to improve the gaseous pollutants removal process by passing the gas stream through the pool of liquid and actively scrubbing the gaseous contaminant out using the agitation thus produced FIG. 2 shows an alternate embodiment of the present invention where all of the gas flow is forced into the liquid pool 3. Here there are basically two zones with the concentric uniform field, while the embodiment of FIG. 1 has only one. In this embodiment, particles are charged by the action of the corona discharge 8, and then these charged particles pass through the liquid. After emerging from the liquid, the flow enters a zone on the back side of the porous surface 5. All of the gas flow is forced through the porous surface 5 into a third zone 9 where a zone of uniform electric field exits. The flow exits after passing through this third zone 9. Again, as with the embodiment of FIG. 1, any combination of one, two or more sources of high-tension potential 7 may be used.

Figure 3:
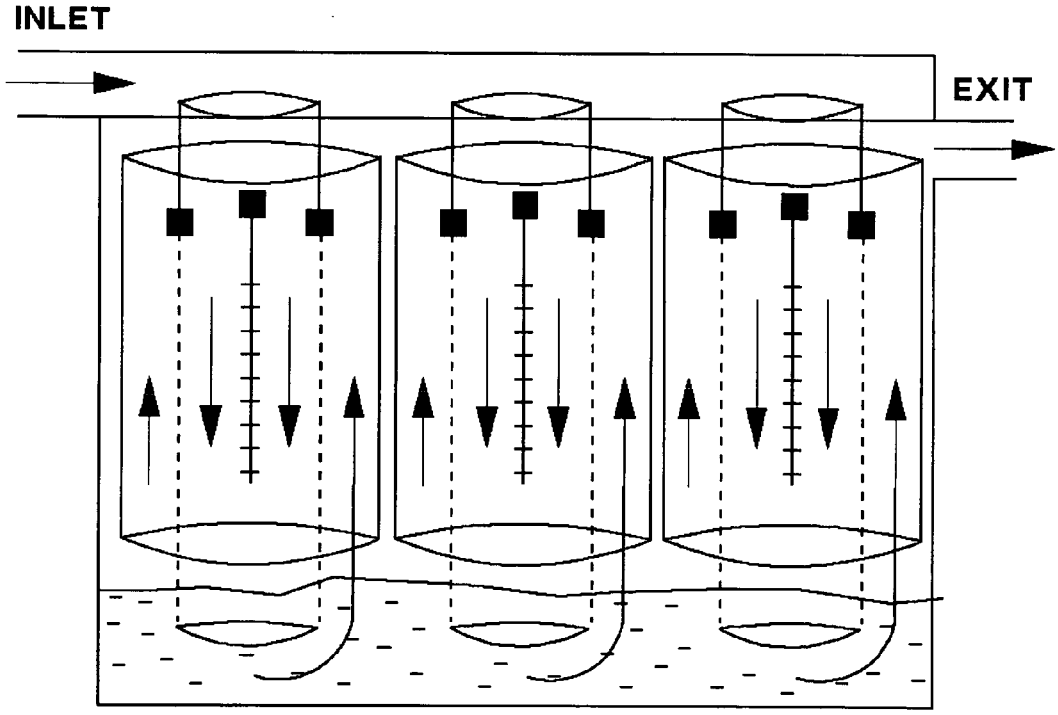
FIG. 3 shows a multi-pipe embodiment of the present invention.

FIG. 3 shows a multi-pipe embodiment of the present invention where several of the units previously described can be placed side-by-side to operate in parallel to allow an increased volume of total filtered gas flow. It is within the scope of the present invention to place units in parallel, serial or in any other combination to achieve efficiencies in various operations.

Several descriptions and illustrations have been presented that aid in understanding the present invention. One skilled in the art will realize that there are numerous changes and variations that can be made without departing from the spirit of the invention. Each of these changes and variations are within the scope of the present invention.

I claim:

1. A hybrid wet collector for a gas flow comprising:

a conductive shell containing a first gas flow zone and a second gas flow zone;

a porous boundary between said first flow zone and said second flow zone;

a gas inlet in gas communication with said first flow zone, and a gas outlet in gas communication with said second flow zone;

wherein a first electrode in said first flow zone creates a corona discharge in said first flow zone such that the gas flow passes through said corona discharge;

wherein a second electrode in said second flow zone creates a uniform electric field such that the gas flow passes through said uniform electric field;

a liquid pool between said first and second zones wherein at least a portion of said gas flow passes through said liquid pool.

2. The hybrid wet collector for a gas flow of claim 1 wherein a portion of said gas flow passes through said porous boundary.

3. The hybrid wet collector for a gas flow of claim 1 wherein said liquid pool performs chemical scrubbing of said gas flow.

4. The hybrid wet collector for a gas flow of claim 1 wherein said corona discharge occurs between said first electrode and said porous boundary.

5. The hybrid wet collector for a gas flow of claim 1 wherein said uniform electric field exists between said second electrode and said porous boundary.

6. The hybrid wet collector for a gas flow of claim 1 wherein said uniform electric field exists between said second electrode and said conductive shell.

7. The hybrid wet collector for a gas flow of claim 1 further comprising a liquid flow on at least one surface of said porous boundary or an inner surface of said conductive shell.

8. The hybrid wet collector for a gas flow of claim 1 wherein said porous boundary extends into said liquid pool.

9. The hybrid wet collector for a gas flow of claim 1 wherein said first electrode and said second electrode are at substantially the same electrical potential.

10. The hybrid wet collector for a gas flow of claim 1 wherein said porous boundary and said housing are at the same electrical potential.

11. The hybrid wet collector for a gas flow of claim 1 wherein an engineered porous material is used on at least one of said first or second electrodes or said porous boundary or an inner surface of said conductive shell.

12. A hybrid wet collector comprising:

at least three concentric tubes, a solid outer tube, a porous middle tube and a solid inner tube all having first and second ends, said collector being adapted for a gas flow to enter the solid inner tube from the first end; the outer tube having a closed second end containing a liquid pool, the second end of the inner tube extending into said liquid pool, wherein said gas flow passes through the liquid pool from the inner tube into a zone between the solid outer tube and the porous middle tube, and wherein the gas flow then exits the first end of the middle tube;

said collector having a first electrode located in said inner tube electrically coupled to a high-tension source configured to produce a corona discharge to said inner tube, said porous middle tube also connected to a high-tension source, said porous middle tube and said inner tube configured to produce a uniform electric field between the middle tube and the inner tube.

13. The hybrid wet collector of claim 12 wherein said liquid pool performs active chemical scrubbing of said gas flow.

14. The hybrid wet collector of claim 12 wherein at least one surface of said porous inner tube is an engineered porous material.

15. The hybrid wet collector of claim 12 further comprising a liquid flow on at least one surface of said inner tube.

16. A hybrid wet collector comprising:

at least three concentric conductive tubes forming three zones, an inner zone, a middle zone and an outer zone with an electrode disposed in the inner zone, said electrode configured to produce a corona discharge between said electrode and a surface of said inner tube, the middle tube and the outer tube configured so that a uniform electric field is established between said middle tube and said inner tube;

wherein, at least one of said inner tube or said middle tube is porous;

and wherein, said outer tube has a closed bottom end with a pool of liquid disposed in said closed bottom end, and wherein the inner tube extends into said liquid pool;

whereby, a gas flow enters said inner tube, flows through said inner tube into said liquid pool and into one of: 1) a zone between said inner tube and said middle tube, or 2) a zone between said middle tube and said outer tube, and whereby said gas flow subsequently exits said collector.

17. The hybrid wet collector of claim 16 wherein said inner tube is porous and part of said flow passes through said inner tube.

18. The hybrid wet collector of claim 16 wherein said middle tube is porous and all of said flow passes through said outer tube.

19. The hybrid wet collector of claim 16 wherein said liquid pool performs active chemical scrubbing of said gas flow.

20. The hybrid wet collector of claim 16 wherein said liquid pool is agitated.

* * * * *